US007124921B1

(12) United States Patent
Hubbell

(10) Patent No.: US 7,124,921 B1
(45) Date of Patent: Oct. 24, 2006

(54) MODULAR PERSONAL CARRYING SYSTEM

(76) Inventor: John Hubbell, 87 E. 100 South, Morgan, UT (US) 84050

( * ) Notice: Subject to any disclaimer, the term of this patent is extended or adjusted under 35 U.S.C. 154(b) by 0 days.

(21) Appl. No.: 11/103,746

(22) Filed: Apr. 12, 2005

(51) Int. Cl.
*A45F 3/04* (2006.01)

(52) U.S. Cl. ..... 224/148.2; 224/637; 224/652; 224/222; 224/583

(58) Field of Classification Search ..... 224/148.2, 224/581, 582, 583, 651, 901.8, 650, 661, 224/148.1–7
See application file for complete search history.

(56) References Cited

U.S. PATENT DOCUMENTS

| | | | | | |
|---|---|---|---|---|---|
| 2,167,926 | A | * | 8/1939 | Glasker | 206/581 |
| 4,210,244 | A | | 7/1980 | Westrick | |
| 4,423,834 | A | | 1/1984 | Rush | |
| 4,424,841 | A | * | 1/1984 | Smith | 224/240 |
| 4,515,300 | A | | 5/1985 | Cohen | |
| 4,609,084 | A | * | 9/1986 | Thomas | 190/110 |
| 4,673,070 | A | * | 6/1987 | Ambal | 190/108 |
| 4,844,307 | A | | 7/1989 | Rutledge | |
| 4,848,624 | A | * | 7/1989 | Clem | 224/222 |
| 5,005,744 | A | | 4/1991 | Gleason | |
| 5,184,763 | A | * | 2/1993 | Blaisdell et al. | 224/153 |
| 5,205,448 | A | * | 4/1993 | Kester et al. | 224/575 |
| 5,240,156 | A | * | 8/1993 | Sicotte et al. | 224/583 |
| 5,282,557 | A | * | 2/1994 | McCook | 224/148.2 |
| 5,465,889 | A | * | 11/1995 | Smith | 224/677 |
| 5,573,166 | A | | 11/1996 | Leja | |
| 5,603,441 | A | | 2/1997 | Easter | |
| 5,615,812 | A | * | 4/1997 | Martin | 224/153 |
| 5,628,443 | A | * | 5/1997 | Deutsch | 224/583 |
| 5,704,530 | A | | 1/1998 | Scherer | |
| 5,729,869 | A | * | 3/1998 | Anscher | 24/3.1 |
| 5,743,447 | A | * | 4/1998 | McDermott | 224/153 |
| D395,546 | S | * | 6/1998 | Houtan | D3/226 |
| 5,873,504 | A | * | 2/1999 | Farmer | 224/576 |
| 5,950,896 | A | | 9/1999 | Theodore | |
| 5,975,387 | A | * | 11/1999 | Gleason et al. | 224/148.2 |
| 5,991,925 | A | * | 11/1999 | Wu | 2/102 |
| 6,135,334 | A | | 10/2000 | Seichter | |
| 6,314,579 | B1 | | 11/2001 | Marcon | |
| 6,364,365 | B1 | * | 4/2002 | Caplan | 283/80 |
| 6,547,110 | B1 | | 4/2003 | O'Hare | |
| 6,619,519 | B1 | | 9/2003 | Nix et al. | |
| 6,659,320 | B1 | * | 12/2003 | Alves et al. | 224/581 |

(Continued)

*Primary Examiner*—Nathan J. Newhouse
*Assistant Examiner*—Justin M. Larson
(74) *Attorney, Agent, or Firm*—Starkweather & Associates; Michael W. Starkweather; Jason P. Webb

(57) ABSTRACT

A modular personal carrying system for facilitating the carrying of objects by a user. There may be included a first personal carrying device configured to removably attach to the user. There may also be a second personal carrying device configured to removably attach to the user. Also, there may be a removable container configured to removably attach to the first personal carrying device and to the second personal carrying device and configured to contain an object therein. A first personal carrying device may be a backpack. A second personal carrying device may be a belt. The backpack and the belt may be configured to attach to each other. There may also be a leg belt. Also, there may be a second removable container that may be configured to removably attach to a bottom surface of the removable container and also to a bottom surface of the backpack. The first removable container may be configured to removably attach to the bottom surface of the backpack. Also, the first removable container and the second removable container may both be fanny packs.

12 Claims, 8 Drawing Sheets

U.S. PATENT DOCUMENTS

D487,189 S * 3/2004 Ukitsu et al. ..... D3/217
6,702,168 B1 * 3/2004 Panosian ..... 224/583
6,722,543 B1 * 4/2004 Fitzgerald et al. ..... 224/583
6,772,925 B1 8/2004 O'Hare
2004/0159691 A1 * 8/2004 Dingman et al. ..... 224/656
2005/0072825 A1 * 4/2005 Barr ..... 224/661

* cited by examiner

MODULAR PERSONAL CARRYING SYSTEM

BACKGROUND OF THE INVENTION

1. Field of the Invention

The present invention relates to personal carrying devices, specifically to modular personal carrying systems.

2. Description of the Related Art

Personal carrying devices have been used since ancient times. There has always been a need to conveniently carry articles on ones person. Personal carrying needs vary widely over different individuals, situations, and needs. Accordingly, the many kinds of bags, backpacks, slings, rucksacks, harnesses, attaches, briefcases, carry-ons, carryalls, cases, diddies, duffels, grub-bags, handbags, haversacks, holdalls, kits, knapsacks, packs, packets, pockets, pokes, kit bags, purses, sacs, sacks, saddlebags, satchels, suitcases, totes, and other personal carrying devices are sometimes adapted and/or specialized to match particular needs. Specialization is often at the expense of fulfilling other needs.

While some personal carrying needs are typically adequately fulfilled by specialized carrying devices, other personal carrying needs are not. For example, there are some situations where the advantages of specialization, such as efficient use of space, weight, weight distribution, etc., are greatly appreciated, but the personal carrying needs of the situation are variable and changing over time. Further, it may be inconvenient to have multiple carrying devices to properly address the changing needs.

As an example, hiking and camping often require very specialized carrying devices configured to efficiently use and manage limited space and weight requirements as well as properly distribute weight over a person to facilitate long hikes over sometimes difficult terrain. Further, wherein the user may intend to spend significant time in the outdoors, there is a great need to bring enough gear and supplies to keep the user healthy and safe for several days.

However, the user may intend to hike a distance into the outdoors and establish a base camp. There, a majority of the gear and supplies may be left while the user then sets out on smaller excursions in surrounding areas, for example taking day hikes in order to explore, experience the area, taking samples, survey, or any other reason. During these smaller excursions a very different set of needs are present and because of the circumstances, specialized personal carrying devices are very much in demand. However, it is inconvenient and inefficient to carry multiple sets of specialized carrying devices.

As another example, a personal carrying device may be used primarily as a storage device, like a 72-hour kit. In such a case, the device will typically be used to store items, but in case of an emergency or other similar event, the personal carrying device may be used to carry the contents thereof some previously unknown distance for some previously unknown purpose. Therefore, it is likely that the device may be required to serve any number of divergent needs. Thus, specialization in one aspect may render the device inadequate for the eventual actual need.

Still further, a user may take many different kinds of trips, such as trips involving camping, fishing, hunting, search and rescue, reconnaissance, exploration, travel and any other kinds of trips where it is convenient or necessary to carry items on ones person. Therefore an individual may have greatly changing needs. As it is always beneficial to have specialized personal carrying devices, it would be beneficial, but inconvenient and expensive, to purchase many different specialized personal carrying devices adapted to the particular needs of each trip.

Yet still further, the particular needs of each trip may be unknown for a time, even unknown till the time of the immediacy of the need. In such cases it may be impractical or impossible to obtain an appropriately specialized personal carrying device.

Again further, personal carrying devices often contain many different types of contents. Some personal carrying devices include only a small number of compartments or separate storage areas. This has the advantage of keeping all the materials in only one or a few locations, making it simple to determine where to begin looking for an item. However, actually finding the appropriate item may be difficult, as it may be lost among a large number of other items.

Some personal carrying devices include a large number of compartments or storage areas. This allows for better organization of the contents of the personal carrying device. However, unless the organization structure is committed to memory, or marked on the device, determining the proper compartment for each object may be difficult. Further, wherein the organization of contents of the personal carrying device is marked thereon, changes in the organization may lead to confusion or may render the personal carrying device unfit for use.

What is needed is a personal carrying device or system that may be configured by a user to be adapted to a wide variety of needs.

SUMMARY OF THE INVENTION

The present invention has been developed in response to the present state of the art, and in particular, in response to the problems and needs in the art that have not yet been fully solved by currently available personal carrying devices. Accordingly, the present invention has been developed to provide a modular personal carrying system.

There may be a modular personal carrying system for facilitating the carrying of objects by a user. The modular personal carrying system may include a first personal carrying device configured to removably attach to the user. There may also be a second personal carrying device configured to removably attach to the user. Also, there may be a removable container configured to removably attach to the first personal carrying device and to the second personal carrying device and configured to contain an object therein.

In one embodiment, there is a modular personal carrying system that may include a first personal carrying device that is a backpack. Further, there may be a second personal carrying device that may be a belt. Still further, the backpack and the belt may be configured to attach to each other. There may also be a leg belt. Also, there may be a second removable container that may be configured to removably attach to a bottom surface of the removable container and also to a bottom surface of the backpack. The first removable container may be configured to removably attach to the bottom surface of the backpack. Also, the first removable container and the second removable container may both be fanny packs.

There may be a modular personal carrying system having a removable container that includes a tagging patch attached to a visible portion of the removable container and configured to label intended contents of the removable container.

In another embodiment, there may be a plurality of removable containers and a plurality of personal carrying devices, wherein each removable container is configured to attach to at least two personal carrying devices. In still another embodiment, there may be a water holder attached to the first personal carrying device and a water tube configured to permit a user to draw liquid from the water holder while wearing the first personal carrying device. Also, the plurality of removable containers may comprise at least three diverse removable containers, and each may vary by about ten percent in at least one metric.

In a still yet different embodiment there may be a modular personal carrying system for permitting a user to perform diverse carrying tasks. The modular personal carrying system may include a backpack, a belt, and a plurality of removable containers. The backpack may be configured to be worn by the user and may include a plurality of coupling devices on an outer surface of the backpack. Further, the backpack may include a coupling device on a lower surface of the backpack. The belt may be configured to be worn by the user and may be removably attachable to the backpack at a lower surface. The plurality of removable containers may be configured to attach to an outer surface of the backpack by means of a coupling device configured to couple to at least one of the plurality of coupling devices on the backpack. Also, each of the plurality of removable containers may include a holding portion configured to contain objects. Further, one or more of the plurality of removable containers may include a tagging patch that may be removably coupleable to the holding portion and configured to be displayed thereon.

In another embodiment, there may be a first set of loops on the outer surface of the backpack and a second set of loops disposed within at least one of the plurality of removable containers. Also, there may be a first lower container disposed on the belt and removably coupleable to the backpack. Further, there may be a second lower container removably coupleable to the belt and removably coupleable to the backpack.

In again another embodiment, there may be a first set of coupling devices configured to permit attachment of the plurality of removable containers in substantial vertical relation one to another and adjacent to a left surface of the backpack. There may further be a second set of coupling devices configured to permit attachment of the plurality of removable containers in substantial vertical relation one to another and adjacent to a right surface of the backpack. In addition, there may be a third set of coupling devices configured to permit attachment of a single removable container on a back surface of the backpack and adjacent to both the first set of coupling devices and the second set of coupling devices.

In still another embodiment, there may be a kit bag configured to attach to the third set of coupling devices and to attach to a leg of the user. In a still yet another embodiment, there may be three distinct sizes of removable containers. Also, the kit bag may include a set of loops fixedly disposed therein.

Also, the plurality of removable containers may each include a tagging patch and are may be configured to contain and organize materials for a 72-hour kit. Still also, there may be a water holder attached to the backpack and a water tube configured to permit the user to draw a liquid from the water holder while wearing the backpack.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
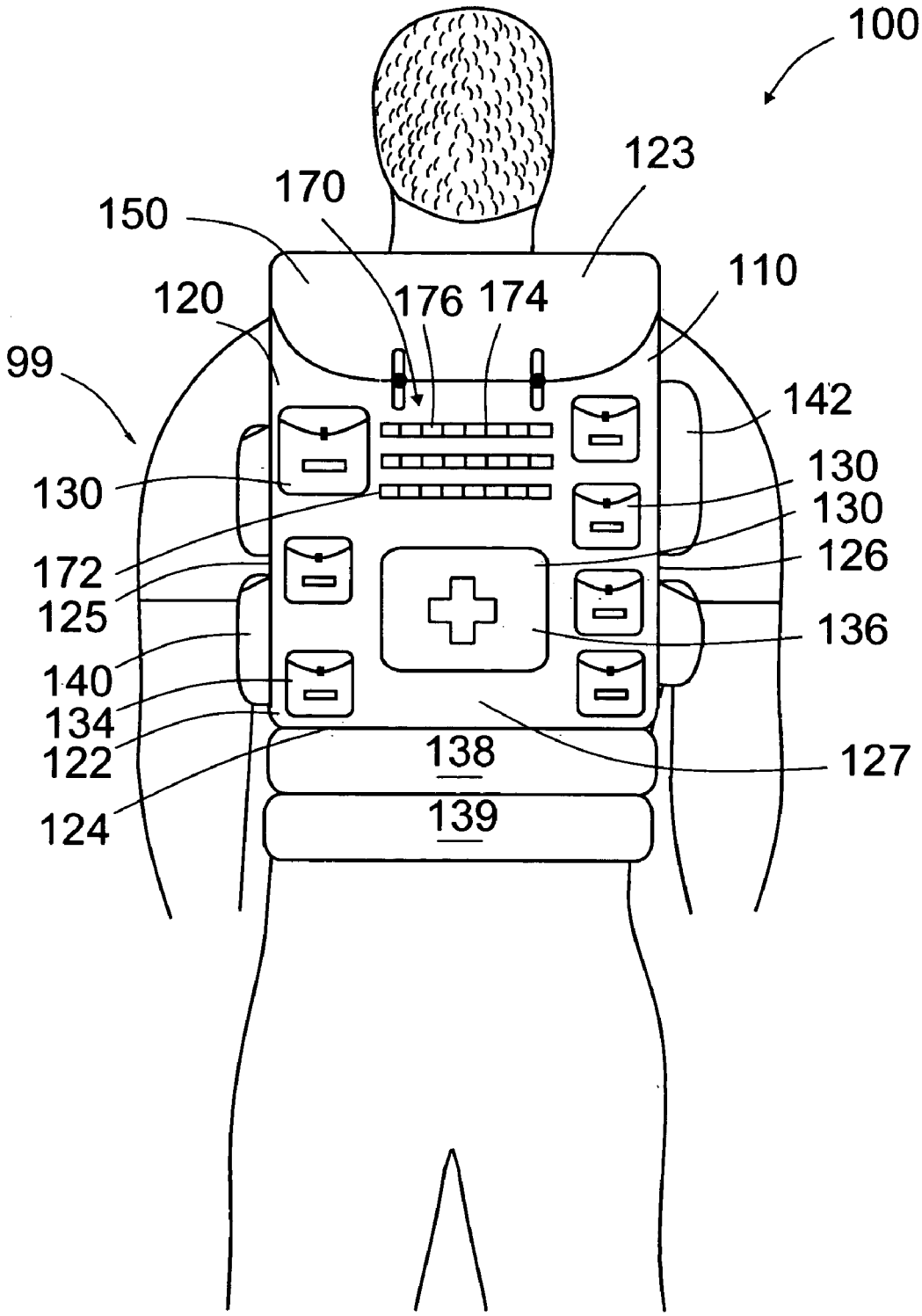
FIG. 1 illustrates a back perspective view of a person wearing a personal carrying system according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

Looking now to the figures, FIG. 1 illustrates a back perspective view of a person 99 wearing a personal carrying system 100 according to one embodiment of the invention. There is a personal carrying device 110, in particular a backpack 120, shown positioned on the back of a person 99 and configured to couple removable containers to the person. The backpack 120 may be of any shape, size, and/or material. The backpack 120 has an outer surface 122, comprising a top surface 123, a bottom surface 124, a left surface 125, a right surface 126, a front surface (not shown), and a back surface 127. The front surface is not shown and includes the surface of the backpack 120 that is in contact with the back of the person 99.

Shown are removable containers 130 removably attached to the outer surface 122 of the backpack 120. The removable containers 130 shown include a plurality of pockets 134 disposed on the back surface 127 vertically adjacent one to another and adjacent to either the left surface 125 or the right surface 126, a kit bag 136 disposed on the back surface 127 near or adjacent to the bottom surface 124, a first lower container, or first fanny pack 138 disposed on the back surface 127 and/or the bottom surface 124, and a second lower container, or second fanny pack 139 disposed below the first lower container 138. There may also be side bags 140 disposed on the left and/or right surfaces 125 and 126. There may also be a water holder 142, which may be disposed on the outer surface 122, which may be more particularly disposed on the right surface 126 or on the left surface 125. Each of the removable containers 130 are physically coupled to the backpack 120.

The removable containers 130 may be made of any material including but not limited to fabric, plastic, metal, composite, wood, ceramic, synthetic, natural, resin, etc. Further, the removable containers 130 may be of any shape and size. Preferably there will be a variety of sizes of the removable containers 130. For example, a set of removable containers 130 may include those having different values of a metric (such as length, width, depth, volume, surface area, weight, strength, etc.) such as removable containers of eight, six, and four inches in length. Also, the removable containers may include a labeling system. Also, a removable container 130 may include more than one attachment system, for example, there may be belt loop strips adjacent to hook and loop strips.

The removable containers 130 may be coupled to the backpack 120 in any way, including coupling devices such as loops, snaps, clips, hook and loops systems, hooks, interlocking members, zippers, buckles, and any other fastening means or methods. Preferably, there will be pairs of strips of 2 inch wide hook and loop coupling means. Further, the various removable containers 130 may each be coupled differently, for example, the first lower container 138 may be coupled to the backpack 120 by a zipper while the second lower container 139 may be coupled indirectly to the backpack 120 by a hook and loop system coupling to the first lower container 138.

Further, the first lower container 138 may be coupled to a belt (not shown) and removable from both the personal carrying device 110 and the second lower container 139, thereby usable independent from the personal carrying device 110 and the second lower container 139. The second lower container 139 may also be configured to be attachable to the personal carrying device 110 in place of the first lower container 138.

In the shown embodiment, the backpack 120 includes a closable opening 150 (shown in the closed position and forming a portion of the top surface 123 of the backpack 120) configured to permit loading and securing of contents within the backpack 120. The removable containers 130, as shown, are advantageously capable of being loaded and secured independent of the closable opening 150, and may be loaded with any material. For example, the kit bag 136 may be filled with first aid supplies. The kit bag 136 may then be attached to the outer surface 122 of the backpack 120 instead of being inserted into the backpack 120 through the closable opening 150, thereby providing quick and easy access to first aid supplies without limiting access to the contents of the backpack 120. Further, the plurality of pockets 134 may be filled with snacks, insect repellant, samples, etc. In this manner, materials may be made to be easily available without having to open the backpack 120, itself.

Further, as the removable containers 130 are detachable, they may be filled independent of the backpack, even at a distance. Therefore, where it may be convenient or necessary to not bring the entire backpack 120 or personal carrying system 100 to a location where one of the removable containers 130 is intended to be filled or otherwise used, the removable container 130 may detach and be used at a distance from the backpack 120.

In operation, the backpack 120 and the removable containers 130 may be used in any combination, allowing a user to configure the personal carrying system 100 to a large variety of specialized needs. Contents may be organized differently over time, thereby permitting a user to customize the personal carrying system to current needs and convenience. For example, the removable containers 130 may be firmly attached to the backpack 120 during a trek to a base camp. After emptying a majority of the contents of the personal carrying system 100 at a base camp, the removable containers 130 may be separated from the backpack 120 and the various components of the personal carrying system 100 may be used as needed for smaller trips of varying purpose.

Further shown, there is a set of loops 170. The set of loops 170 may be formed by attaching a strip 172 at lines 174, preferably by sewing the strip 172. The loop portions 176 of the strip 172 between the lines 174 may be used to removably attach and/or organize tools or other objects therein. Preferably the strip 172 is of a flexible and/or elastic material. Preferably, the set of loops will comprise nylon webbing and may be used as tie points.

Figure 2:
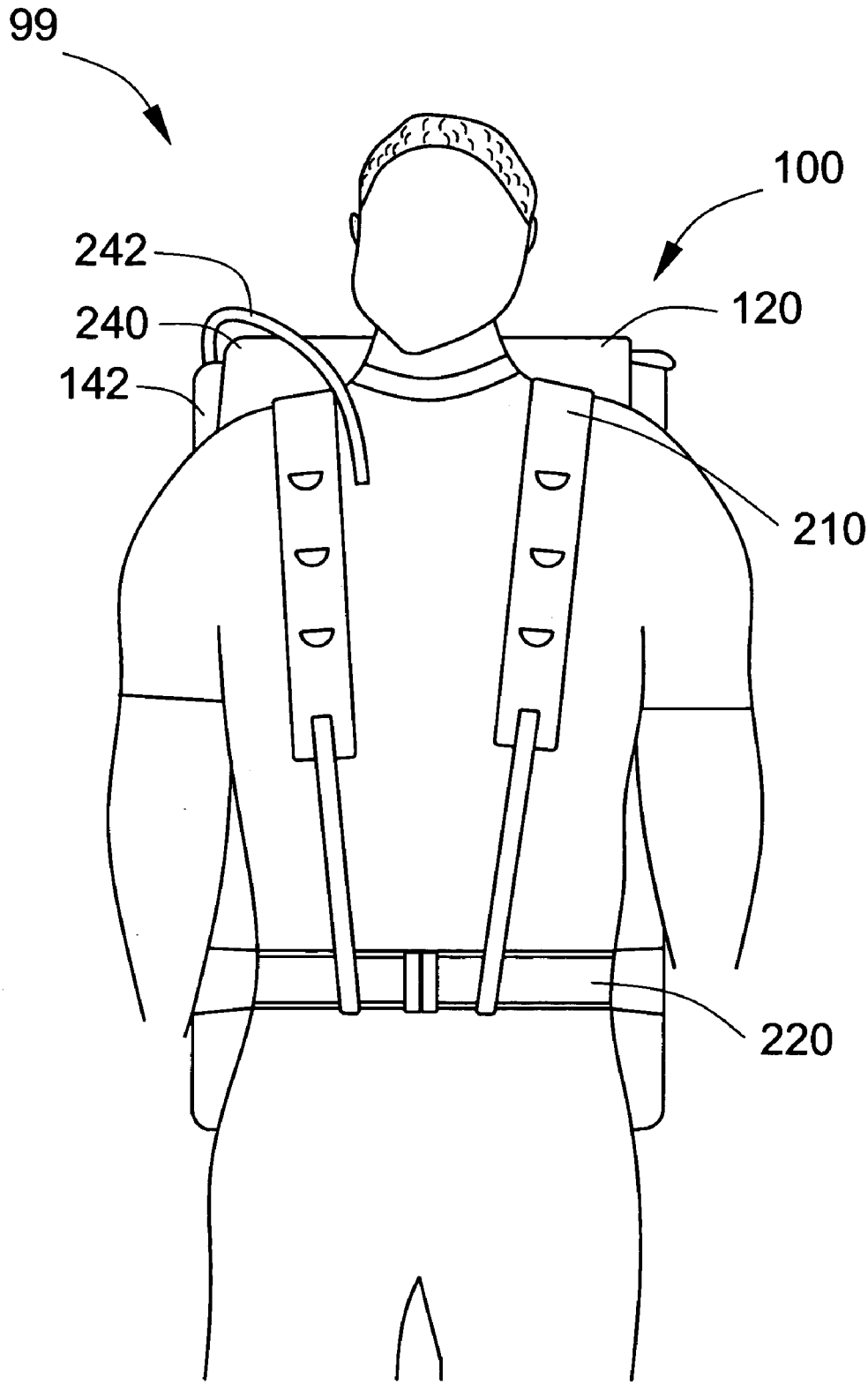
FIG. 2 illustrates a front perspective view of a person wearing a backpack.

Turning now to FIG. 2, there is illustrated a front perspective view of a person 99 wearing a personal carrying system 100 according to one embodiment of the invention. In particular, there is shown a backpack 120 coupled to a person 99 by shoulder straps 210 and a belt 220. There is also shown a water holder 142 and accompanying water tube 242. The shoulder straps 210 are attached to the backpack, preferably at the top surface 123 or the front surface 240. Further, the shoulder straps may be coupled, preferably removably coupled, to the belt 220.

In operation, the belt 220 and shoulder straps 210 removably couple the backpack 120 to the person 99. Also, the water holder 142 may contain water, either directly or indirectly. The water tube 242 permits the person 99 to drink water from the water holder 142.

Figure 3:
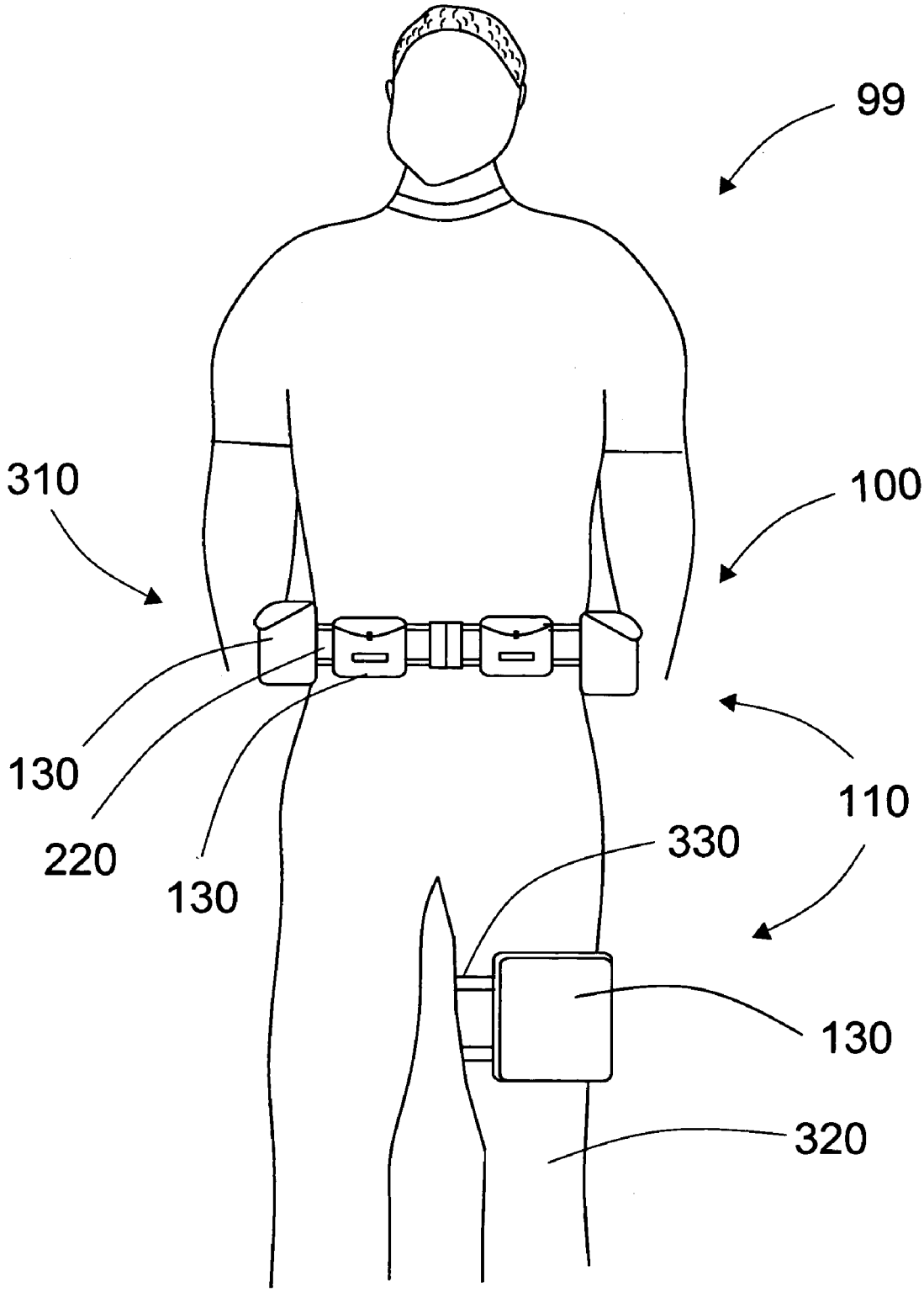
FIG. 3 illustrates a front perspective view of a person wearing a personal carrying system according to one embodiment of the invention.

FIG. 3 illustrates a front perspective view of a person 99 wearing a personal carrying system 100 according to one embodiment of the invention. There is shown two personal carrying devices 110, a waist belt 220 around a waist 310 of the person 99 and a leg belt 330 around a leg 320 of a person 99. The waist belt 220 is configured to receive removable containers 130; in particular it may be configured to receive the same removable containers 130 discussed in FIG. 2. The leg belt 330 is configured to receive removable containers 130, in particular it may be configured to receive the same removable containers 130 discussed in FIG. 2 and/or those removable containers 130 that may be attachable to the waist belt 220. Further, the waist belt 220 may be configured to receive the same removable containers 130 that may be attachable to the leg belt 220. The waist belt is preferably a two to a two-and-a-half inch wide web belt and may be configured to receive attachment clips, such as those used by the military. The leg belt 330 may also be integral to a removable container 130, wherein the removable container 130, such as the kit bag 136 shown in FIG. 1, may have straps 330 thereon configured to permit attachment about the leg 320 of a person 99.

In operation, the waist belt 220 and/or the leg belt 320 may be used to removably attach removable containers 130 to the person 99. The removable containers 130 may be removed from a personal carrying device 110 such as a backpack 120 (See FIG. 2), a waist belt 220, and/or a leg belt 330. The removable containers 130 may be subsequently used unattached, or may be attached to a personal carrying device 110. Wherein there may be significant variety among personal carrying devices 110 and removable containers 130, the personal carrying system 100 may be configured in numerous ways, such that the personal carrying system 100 may be adapted to specially fit current needs and convenience of a user. Thereby the personal carrying system 100 may be a configurably specialized personal carrying system.

Figure 4:
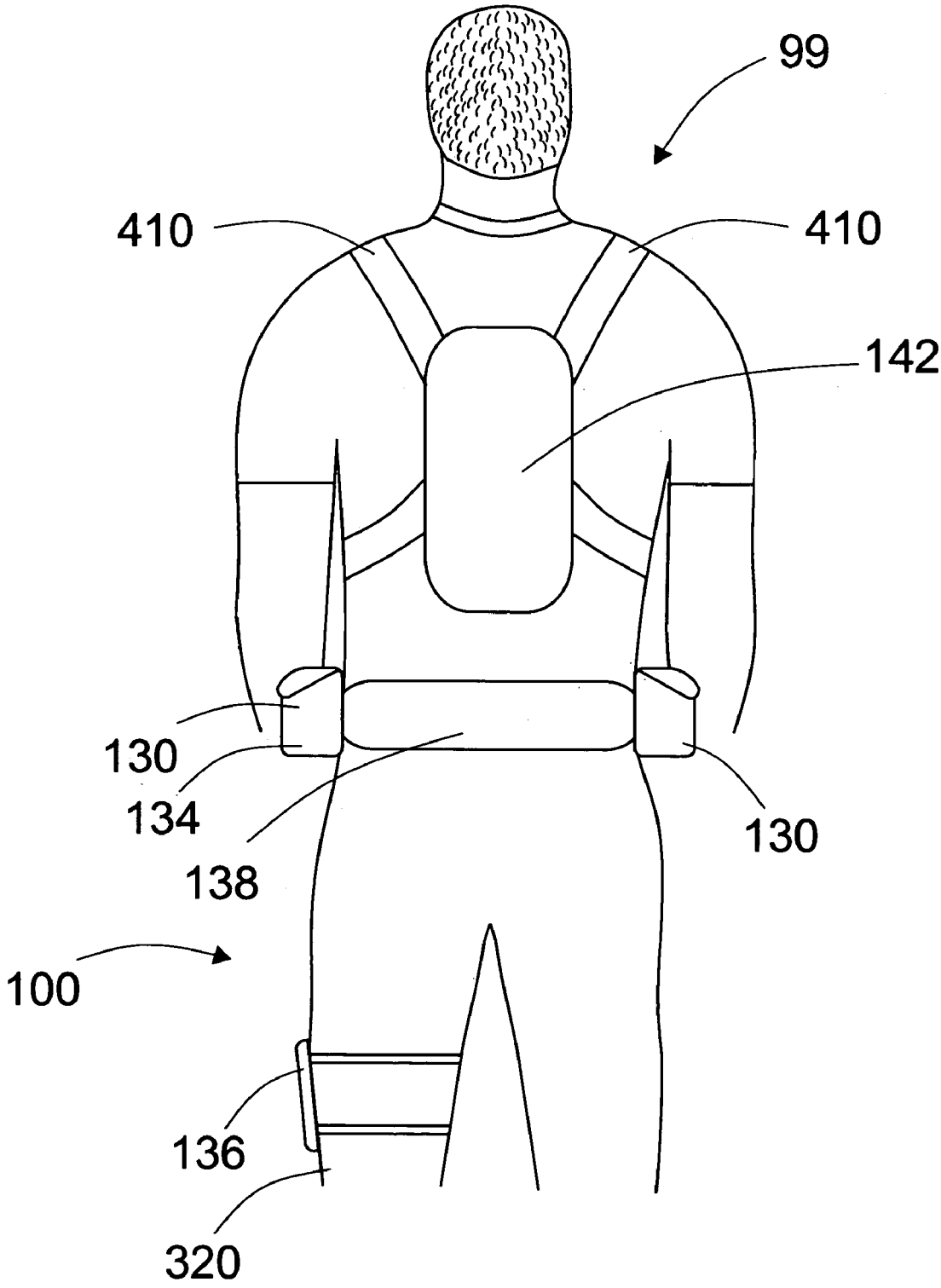
FIG. 4 illustrates a back perspective view of a person wearing a personal carrying system according to one embodiment of the invention.

In another view, FIG. 4 illustrates a back perspective view of a person 99 wearing a personal carrying system 100 according to one embodiment of the invention. Shown are removable containers 130 attached to a belt 220 (not shown, See FIG. 3). There are kit bag(s) 1.36 and/or pocket(s) 134 that may be removably attached to the belt 220. Further there is shown a fanny bag 138 that may be removably attached to the belt 220 or may be non-removably attached to the belt 220. There is also shown a kit bag 136, removably attached to a leg 320 of the person 99. Still further, there is shown a water holder 142 being worn about the person 99.

In operation, the person 99 may detach removable containers 130 from the backpack 120 (See FIG. 1) and separately wear a number of the removable containers 130. These may be worn about various portions of the body as may be appropriate to the attachment means and the needs of the person 99. Further, the water holder 142 may be detached from a backpack 120. Straps 410 attached to the water holder 142 may be loosened and used to attach the water holder 142 to the person 99 in a backpack-like manner. The straps 410 may include hook and loop strips (not shown), wherein tightened straps may be used to couple the water holder 142 to the backpack 120. Therefore, the person may specialize the personal carrying system 100 to current needs.

Figure 5C:
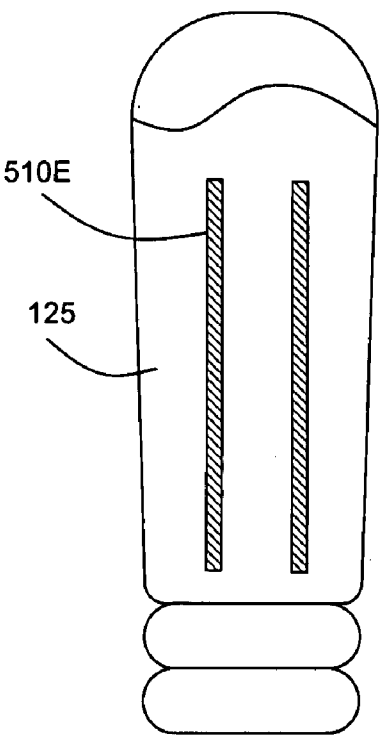
FIGS. 5A–5C illustrate a plan back and side views, respectively, of a personal carrying system according to one embodiment of the invention.
Figure 5B:
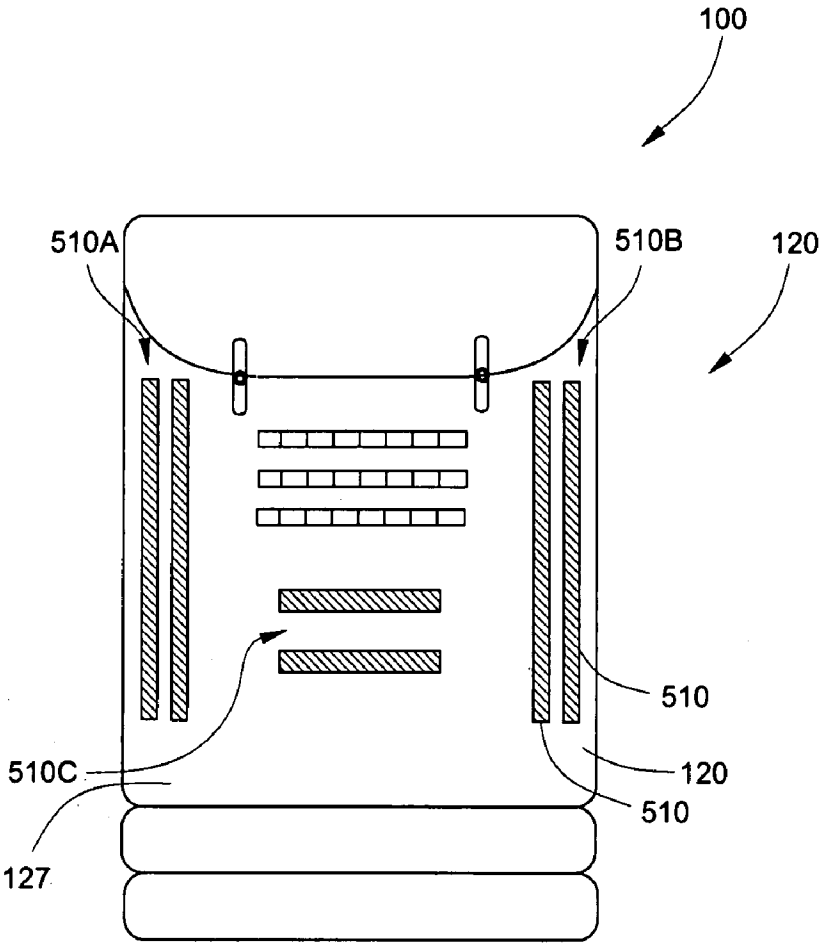
Figure 5A:
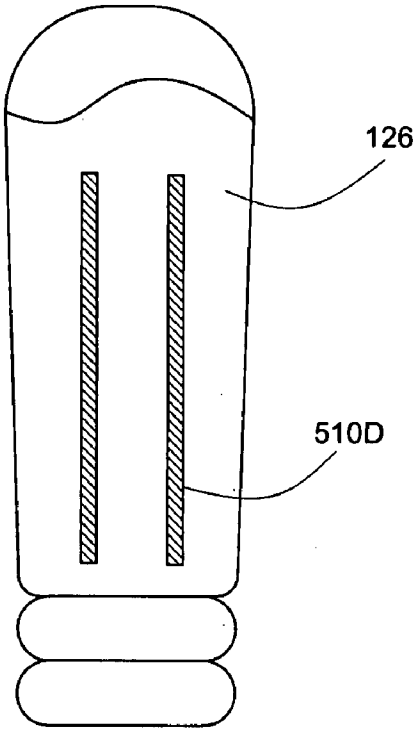

FIGS. 5A–5C illustrate a plan back and side views, respectively, of a personal carrying system 100 according to one embodiment of the invention. Shown are hook and loop type strips 510 on a back surface 127 of a backpack 120. The hook and loop type strips 510 are configured to provide attachment locations for removable containers 130 (not shown, See FIG. 1).

In the illustrated example, there are five sets of hook and loop type strips 510. The first and second set of strips 510A and 510B are configured to provide for an infinite combination of configurations of attachments of a variety of removable containers 130 (See FIG. 1) such as pockets 134 (See FIG. 1). The third set of strips 510C is configured to provide for attachment of a larger kit bag 136 (not shown, See FIG. 1). The fourth and fifth set of strips, 510D and 510E respectively, are configured to provide for an infinite combination of configurations of attachments of a variety of removable containers 130, such as pockets 134.

It may be convenient for a person 99 (See FIG. 1) to place a water holder 142 (See FIG. 1) on either strips 510D or 510E. The water holder 142 may have straps that may be tightened, wherein the straps are configured to couple by hook and loop to the backpack 120 when the straps are in a tightened configuration. Thus, the water holder 142 may attach to the personal carrying device or may also be worn separately like a backpack.

In operation, the personal carrying system 100 is configured to receive removable containers 130 (see FIG. 1) and to be worn by a person. The person may attach removable containers 130 to the personal carrying system in an extraordinary variety of configurations, thus allowing for great flexibility and opportunity for specialization and adaptation to particular needs. As shown, the coupling devices disposed on the outer surface of the personal carrying system 100 permit attachment of removable containers 130 along the entire length of the strips 510. Therefore, attachment configurations need not be in discreet and distinct variations and may also by asymmetrical in the numbers of and sizes of removable containers 130 attached thereto.

Figure 6B:
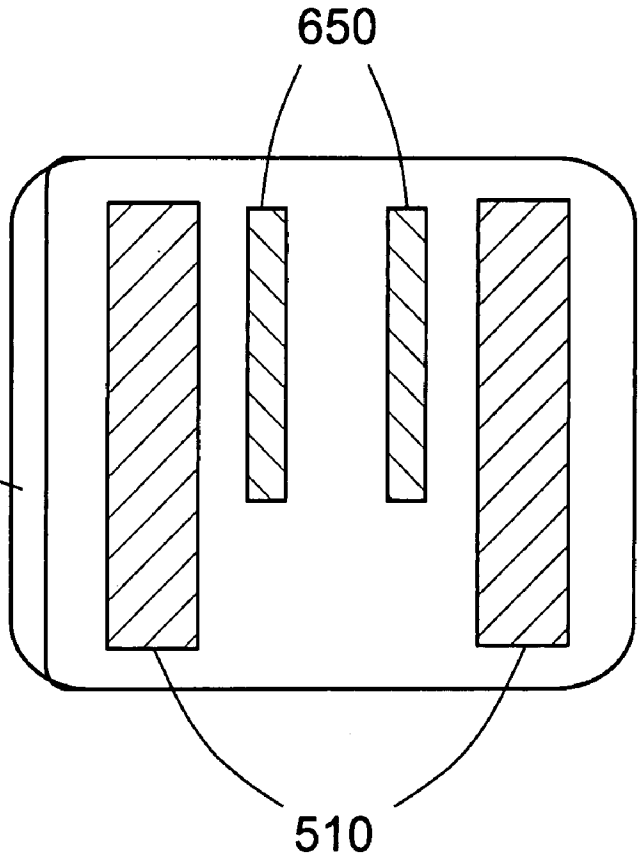
FIGS. 6A and 6B are front and back perspective views, respectively, of a removable container according to one embodiment of the invention.
Figure 6A:
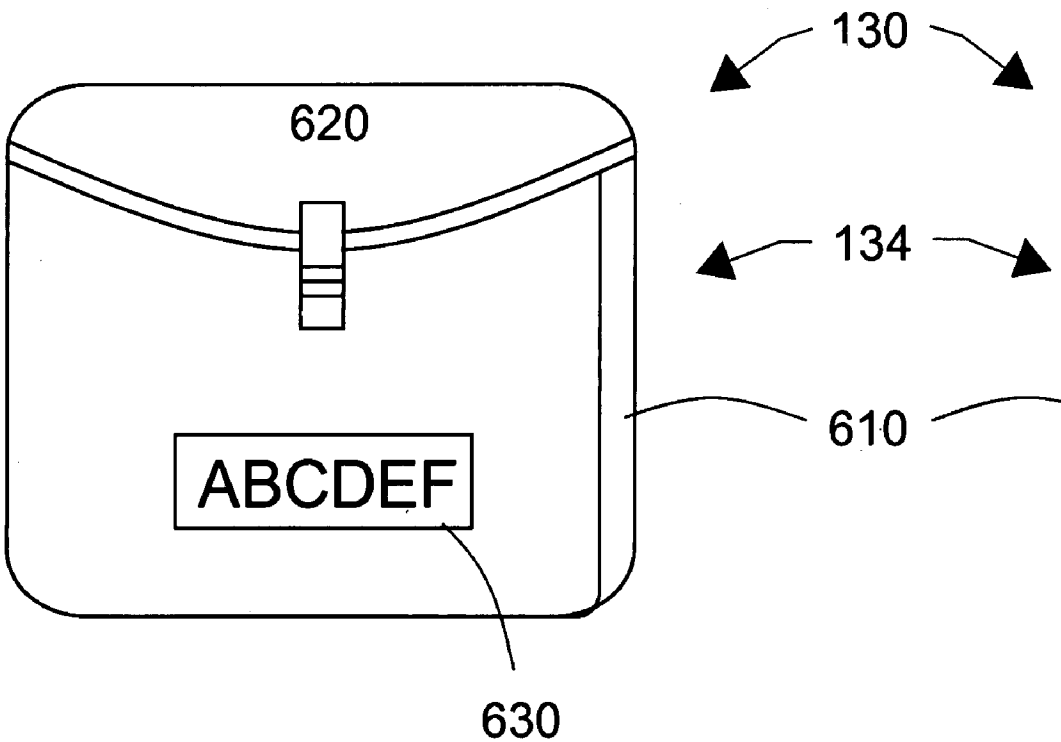

Turning now to FIGS. 6A and 6B, which are front and back perspective views, respectively, of a removable container 130, which may be a pocket 134 (see FIG. 1), according to one embodiment of the invention, the removable container 130 includes a holding portion 610 configured to hold or contain objects therein. There may also be a covering portion 620 configured to removably cover an opening (not shown) in the holding portion 610 whereby items may enter or leave the holding portion 610. The covering portion 620 is preferably hingedly attached to the holding portion 610 near a top of the removable container 130 and preferably detachably connected to the holding portion 610 near a top or front of the holding portion 610. The detachable connection may be by any means for detachably connecting, including but not limited to zippers, clasps, buckles, interlocking members, magnets, hook and loop, line and post, button, snap, etc.

There is also shown in FIG. 6A a tagging patch 630 on the front of the removable container 130. The tagging patch 630 may be prominently displayed on the front of the removable container 130. The tagging patch 630 may be removably attached to the holding portion 610, preferably by means of hook and loop, but may be by any other means. As an example, the tagging patch 630 may be removably coupled to the removable container 130 by a two inch by four inch hook and loop portion. The tagging patch 630 as shown includes a set of letters; however, the tagging patch 630 may include any graphical image.

In operation, the tagging patch 630 may be configured to label the removable container 130, thereby providing knowledge of the intended contents thereof. For example, the tagging patch 630 may designate the primary intended contents of the removable container 130 or may display a phrase or design intended to bring to mind the category of objects contained. As an example, the tagging patch 630 may show a red cross indicating first aid gear, or may display one or more of the phrases such as but not limited to "Trail Snacks," "Light," "Fire," "Insect Repellent," "Bobby's Fishing Lures," "Snake River Samples" to indicate what is intended to be contained therein. The tagging patch 630 may be configured to receive labels, thereby permitting an owner to construct any label desired. The tagging patch 630 may include a programmable electronic display.

Further shown in FIG. 6B are two sets of attachment means. There is shown a pair of hook and loop strips 510 configured to facilitate attachment of the removable container 130 to a personal carrying device 110 (see FIG. 1) such as a backpack 120 (see FIG. 1). There is also shown a pair of slits 650 configured to facilitate attachment of the removable container 130 to a personal carrying device 110 such as a belt 220 (see FIG. 3).

Figure 7A:
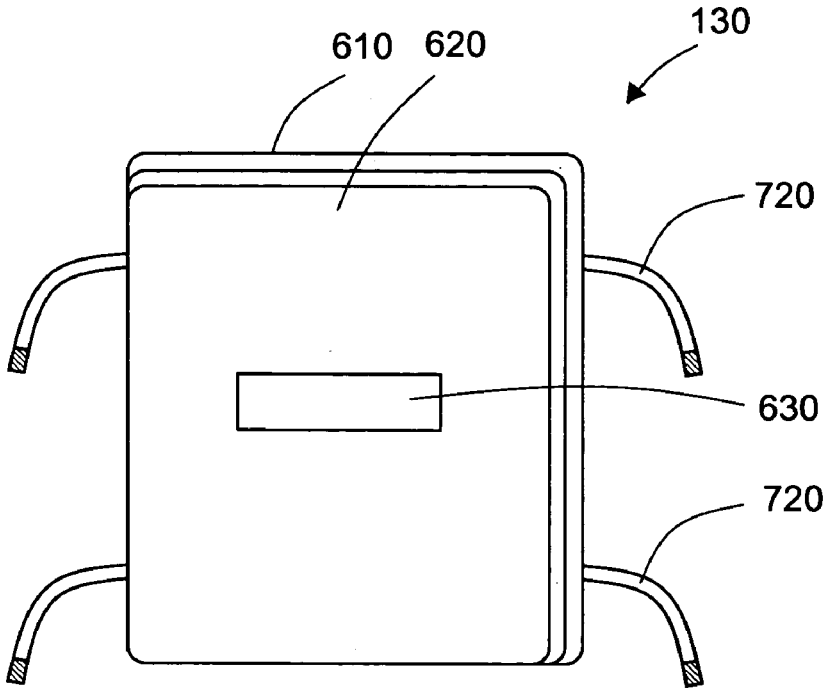
FIGS. 7A–7C illustrate front, back, and open perspective views, respectively, of a removable container according to one embodiment of the invention.
Figure 7B:
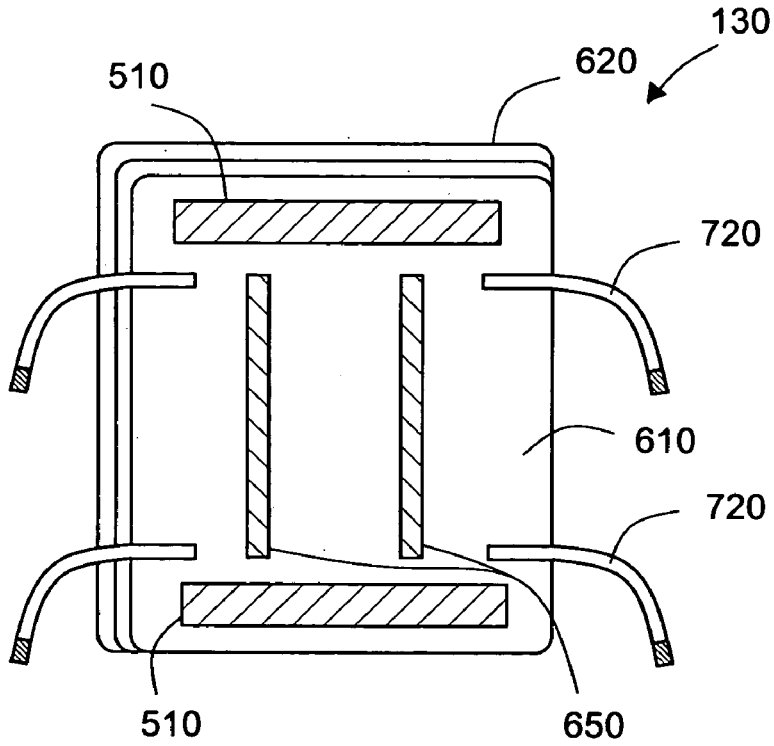
Figure 7C:
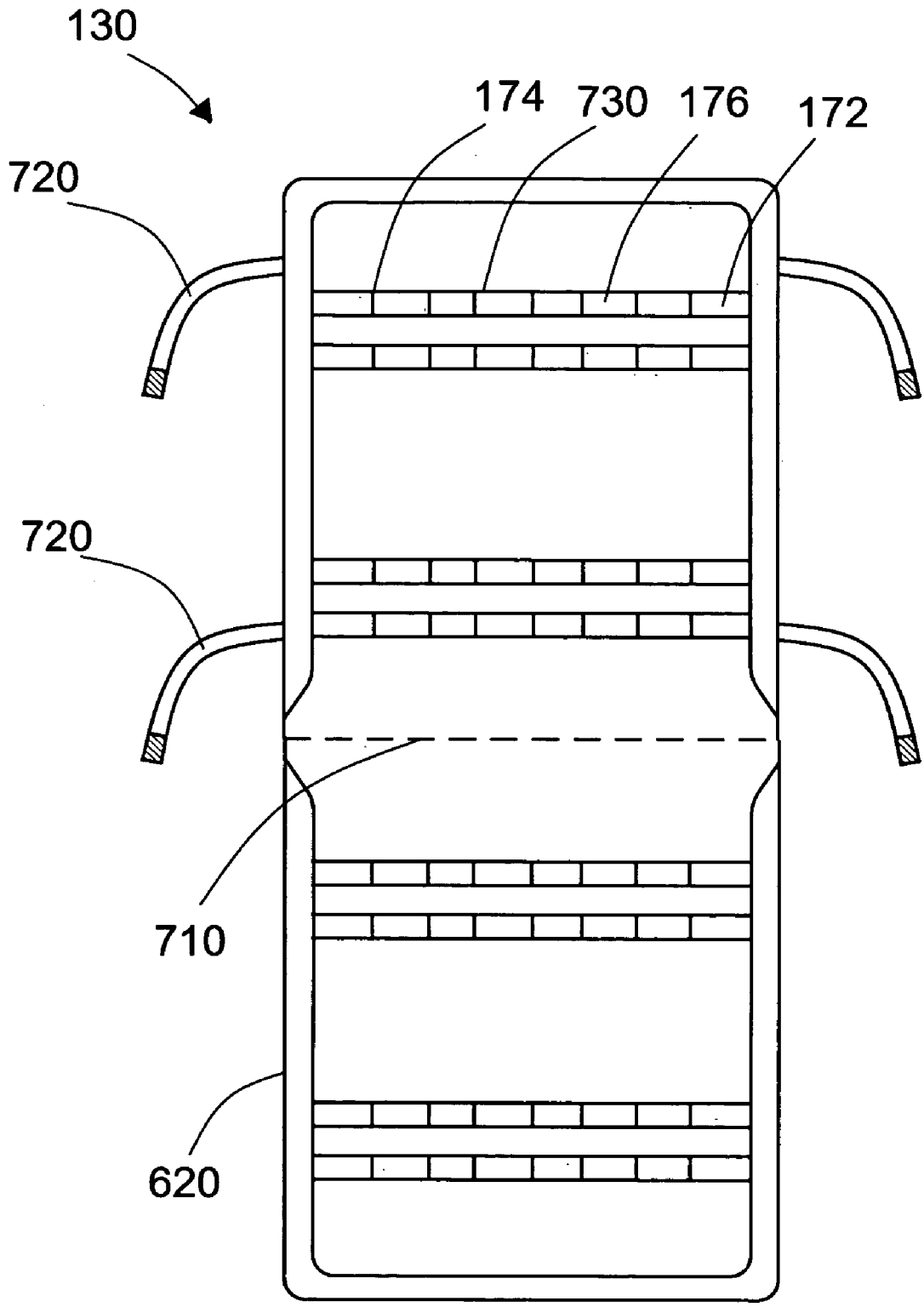

Looking now to FIGS. 7A–7C, there is illustrated front, back, and open perspective views, respectively, of a removable container 130, which may be a kit bag 136 (see FIG. 1), according to one embodiment of the invention. There is shown a holding portion 610 and a covering portion 620. The covering portion 620 may be hingedly connected to the holding portion 610 at hinge 710 as shown in FIG. 7C. There is also shown a tagging patch 630, as well as leg straps 720 configured to facilitate attachment of the removable container about a leg 320 (see FIG. 3) of a person 99 (see FIG. 3). There is also shown a pair of slits 650 and a pair of hook and loop strips 510, each configured to removably attach to a personal carrying device 110 (see FIGS. 1–4) such as a belt 220 (see FIG. 3) and backpack 120 (see FIG. 1) respectively.

Further shown, there is a set of loops 730 inside the removable container 130. The set of loops 730 may be formed by attaching a strip 172 at lines 174, preferably by sewing the strip 172. The loop portions 176 of the strip 172 between the lines 174 may be used to removably attach and/or organize tools or other objects therein. Preferably the strip 172 is of a flexible and/or elastic material.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, although the drawings illustrate only three types personal carrying devices, namely backpack, belt, and leg belt, the invention contemplates using any type of personal carrying device. In particular, any article that may be used to removably attach a removable container to a user. This includes articles such as duffle bags.

As an example of operation, the personal carrying system may be worn by a user in a first full configuration, wherein all of or a substantial majority of the personal carrying system may be simultaneously worn by the user, as exemplified by FIG. 1. In particular, there may be multiple personal carrying devices worn simultaneously and a plurality of removable containers attached thereto. The user may also wear the personal carrying system in a second partial configuration, wherein a significant portion of the personal carrying system is not being worn, as may be exemplified in FIG. 3. Thereby, the user may first carry a large amount of objects in one portion of a trip. Then the user may reduce a carrying load for another portion of a trip. This ability to specialize the personal carrying system to meet current needs may be reproduced indefinitely and a near infinite variety of configurations may be available as there may be a large number of personal carrying devices, removable containers, and attachment locations.

Additionally, although the figures illustrate a particular placement of removable containers, it is understood that the removable containers may be attached in any configuration. Also, although the figures illustrate particular shapes for removable containers, it is understood that containers are known to be any shape and accordingly removable containers may be in any shape.

It is also envisioned that an embodiment of the invention may be particularly adapted for a specific set of purposes. For example, the embodiment may be configured to act as a 72-hour kit. The tagging patches may be specially configured to properly and efficiently label and organize the contents of the 72-hour kit. Further the removable containers, personal carrying devices, and coupling attachments may be sized and configured to especially meet the particular and various needs of a 72-hour kit.

It is expected that there could be numerous variations of the design of this invention. An example is that the backpack could be forward facing, or that the removable containers may not have covers. Also, as with the belt in the illustrations, personal carrying devices may be configured to attach to other personal carrying devices and removable containers may be fixedly attached thereto. Further, removable containers may be attached to other removable containers, thereby being indirectly attached to a personal carrying device.

Finally, it is envisioned that the components of the device may be constructed of a variety of materials, including but not limited to plastic, natural fibers, synthetic fibers, metal, wood, composite, ceramic, glass, resin or any other material.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A modular personal carrying system for facilitating the carrying of objects by a user, comprising:

a first and second personal carrying device configured to removably attach to the user and to each other, wherein the first personal carrying device is larger than the second personal carrying device and the second personal carrying device is configured to be suitable for use as a day pack;

a removable container configured to removably attach to the first personal carrying device and to the second personal carrying device and configured to contain an object therein;

wherein the first personal carrying device is a backpack configured to attach to a back of the user, to carry objects, and to carry a removable container;

wherein the second personal carrying device is a belt configured to attach to a waist of the user, to carry objects, and to carry a removable container wherein the backpack and the belt are configured to attach to each other in a first full configuration wherein they may be simultaneously attached to a user and may be detachable from each other and singly worn by a user in a second partial configuration; and wherein the removable container is a first removable container and further comprising a second removable container configured to removably attach to a bottom surface of the first removable container and a bottom surface of the backpack and the first removable container is configured to removably attach to the bottom surface of the backpack, wherein the first removable container and the second removable container are both fanny packs.

2. The modular personal carrying system of claim 1, further comprising a leg belt configured to attach to a leg of the user and to carry a removable container.

3. The modular personal carrying system of claim 1 wherein the removable container comprises a tagging patch that is attached to a visible portion of the removable container and that is configured to label intended contents of the removable container.

4. The modular personal carrying system of claim 1, further comprising a water holder attached to the first personal carrying device and a water tube configured to permit a user to draw liquid from the water holder while wearing the first personal carrying device.

5. The modular personal carrying system of claim 1, further comprising a first set of loops on an outer surface of the backpack.

6. The modular personal carrying system of claim 1, further comprising a plurality of removable containers and a plurality of personal carrying devices, wherein each removable container is configured to attach to at least two personal carrying devices.

7. The modular personal carrying system of claim 6, wherein the plurality of removable containers comprise at least three diverse removable containers, each varying by at least about ten percent in at least one metric.

8. The modular personal carrying system of claim 1, further comprising:

a first set of coupling devices configured to permit attachment of a plurality of removable containers in substantial vertical relation one to another and adjacent to a left surface of the backpack;

a second set of coupling devices configured to permit attachment of the plurality of removable containers in substantial vertical relation one to another and adjacent to a right surface of the backpack;

a third set of coupling devices configured to permit attachment of a single removable container on a back surface of the backpack and adjacent to both the first set of coupling devices and the second set of coupling devices.

9. The modular personal carrying system of claim 8, further comprising a kit bag configured to attach to the third set of coupling devices and to attach to a leg of the user.

10. The modular personal carrying system of claim 8, further comprising a kit bag removably coupleable to the backpack and including a set of loops fixedly disposed therein.

11. The modular personal carrying system of claim 8, wherein the plurality of removable containers each include a tagging patch.

12. The modular personal carrying system of claim 8, further comprising a water holder attached to the backpack and a water tube configured to permit the user to draw a liquid from the water holder while wearing the backpack.

* * * * *